United States Patent [19]

Canterbury et al.

[11] 4,198,636

[45] Apr. 15, 1980

[54] ANTENNA MOUNTING BRACKET FOR AUTOMOBILE TRUNK LID

[76] Inventors: Robert W. Canterbury, 6442 S. Point Dr., Dallas, Tex. 75248; Jimmy J. Johnston, Rte. 1, Doris Dr., Renner, Tex. 75074

[21] Appl. No.: 678,183

[22] Filed: Apr. 19, 1976

[51] Int. Cl.[2] ..... H01Q 1/32

[52] U.S. Cl. ..... 343/715

[58] Field of Search ..... 343/711, 712, 713, 714, 343/715; 248/514

[56] References Cited

U.S. PATENT DOCUMENTS 3,369,247 2/1968 Bacow ..... 343/715

OTHER PUBLICATIONS

Shur-Lock; C. B. vol. 13, No. 2, 3-76, p. 44, publication date 2-18-76.

*Primary Examiner*—Eli Lieberman

*Attorney, Agent, or Firm*—Crisman & Moore

[57] ABSTRACT

A pivotal mounting bracket is provided for the mounting and concealed storage of an audio antenna upon and within the trunk of an automobile. The bracket comprises an orthogonally pivotal structure, a first end of which is adapted for mounting upon the underneath side of an automobile trunk lid. A second, opposed end of the bracket is adapted for positioning outside the automobile and supporting an antenna upstanding therefrom. The intermediate bracket portion between said ends is configured for interpositioning between the trunk lid and automobile body portion adjacent thereto for facilitating the use of the trunk without interfering with the antenna mounted thereon. The orthogonal pivotability of the bracket then permits the rotation of the antenna from vertical to horizontal positioning and the rotation of the bracket and antenna from a position outwardly extending from the trunk lid to a secured orientation thereunder and in close proximity thereto for efficient concealed storage within the trunk.

4 Claims, 3 Drawing Figures

ANTENNA MOUNTING BRACKET FOR AUTOMOBILE TRUNK LID

BACKGROUND OF THE INVENTION

The present invention relates to automobile antenna mounting brackets, and more particularly, to a collapsible antenna support structure adapted for mounting to an automobile trunk lid.

Audio antennas are provided for automobiles in a plurality of configurations, many of which are incorporated into the automobile at the time of manufacture. Certain types of antennas, however, are not commonly provided by automotive manufacturers. Among these are the high frequency variety utilized for Citizens' Band, or C-B, radios. These short range, vehicle-to-vehicle communication radios comprise an optional vehicle accessory which has achieved widespread popularity among automobile owners, who very often purchase and install the radio themselves. The installation of the radio chassis has been facilitated with numerous mounting bracket designs for the interior of the automobile, providing both accessibility for the operation of the radio and its securement. Because such radios require special antennas, the need has been found for mounting structures constructed with similar design parameters.

Prior art antenna mounting brackets include both permanent and storable structures, each with its own advantages and disadvantages. Permanent antenna mounts subject the antenna to damage or theft, particularly by disadvantageously advertising the existence of the generally expensive c-b radio in the car. Therein lies the main advantage of storable brackets. Among the storable, concealable mounting structures are mounting brackets for positioning in the vicinity of the trunk of the car, which automobile area has been shown to be an effective mounting region. One such antenna mounting bracket, currently commercially available, includes a hinged structure for securement to an inside wall of the trunk, adjacent the trunk lid. The hinged bracket permits positioning of the antenna, secured at one end thereof, outside and juxtaposed to the trunk lid for normal use. When not in use, the antenna and bracket may be pivoted within the trunk space to extend thereacross. While facilitating storage of the antenna, such a bracket is inherently expensive to manufacture and takes up valuable trunk storage space.

It would be an advantage therefore, to avoid the problems of prior art mounting brackets by providing a structure of the storable variety that can be economically manufactured, conveniently handled, and effectively positioned within an automobile storage area without taking up unnecessary space therein. The invention of the present antenna mounting bracket is constructed just for such a purpose. The means provided for storage of the antenna in the present invention is much more efficient than that of prior art, and the manufacture thereof less expensive, in that through orthogonal pivotability, compactness and simplicity may be incorporated.

SUMMARY OF THE INVENTION

The invention relates to apparatus for the generally vertical mounting of an antenna on a trunk lid of an automobile which provides for the repositioning and securing of the antenna in a generally horizontal, concealed configuration within the trunk storage space therein. More particularly, one aspect of the invention involves a frame having a first, outer end of generally planar configuration adapted for securely mounting the antenna thereon. A second, opposed end of the frame is adapted for securing the frame to an underneath portion of the trunk lid for supporting the antenna therefrom. The frame structure between the ends is comprised of an angled strut complementally configured to pass between the trunk lid and the region of the automobile adjacent thereto. To facilitate storage of the antenna and bracket when not in use, the frame is adapted to be orthogonally pivotal about the trunk lid attachment region.

In another aspect of the invention, the frame is formed substantially of sheet metal wherein the angled strut comprising the intermediate body portion thereof includes a generally M-shaped cross-sectional configuration. An intermediate portion of the M-shaped region similarly includes a generally L-shaped region, which angular construction is particularly adapted for being received between the trunk lid and the region of the automobile adjacent thereto. In this manner, the frame may extend outwardly from the automobile in support of the vertically positioned antenna.

Orthogonal pivotability in the frame structure may be provided through an apertured right angle bracket adapted for receiving first and second fastener means therethrough. The fastener means are provided at right angles to one another and facilitate adjustability through orthogonal interconnection of the frame structures coupled thereto. In this manner the antenna and frame body can be pivoted from the vertical position to a generally horizontal orientation and horizontally pivoted to a position against the underneath side of the trunk lid.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION

Figure 1:
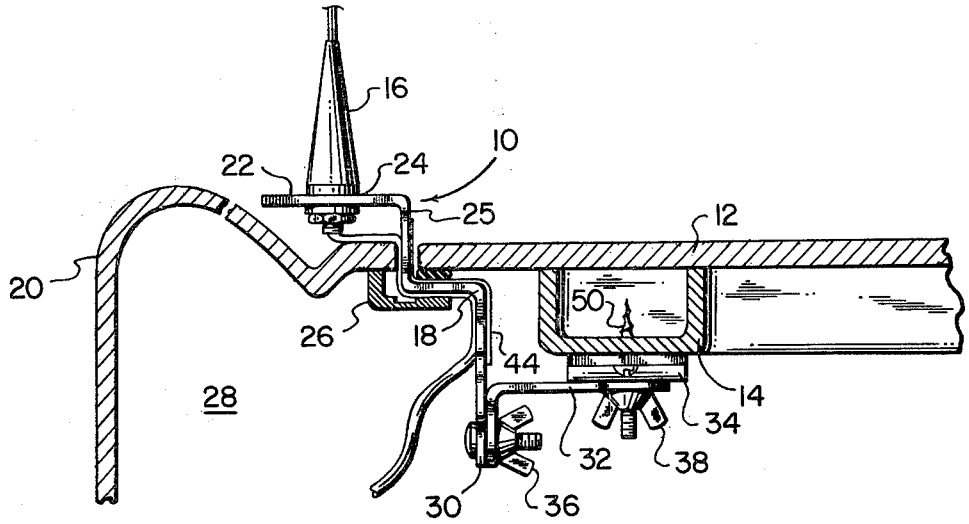
FIG. 1 is a side, elevational view of an antenna mounting bracket constructed in accordance with the principles of the present invention, mounted and shown within a cross-section of a trunk region of an automobile.

Referring first to FIG. 1, there is shown one embodiment of an antenna mounting bracket 10 constructed in accordance with the principles of the present invention. The bracket 10 is shown to be comprised of an angularly formed frame mounted to an automobile trunk lid 12 along a structural member 14 running therealong. The preferred configuration of bracket 10 herein shown will be seen to provide numerous advantages for the mounting and concealed storage of an antenna 16 secured thereto, as discussed in more detail below.

The bracket 10 comprises a generally M-shaped body strut 18 for positioning between the trunk lid 12 and an adjacent automobile body portion 20. The particular angular configuration of strut 18 provides for a laterally extending, outer antenna mounting flange 22 adapted for receiving and securing the antenna 16 upstandingly therefrom. It may be seen that the planar construction of mounting flange 22 facilitates conventional securing of the antenna 16 thereto within an aperture 24 formed therethrough. In this manner the antenna 16 may be rigidly positioned outside the trunk of an automobile while not interfering with the use of the trunk lid 12. The body 18 thus includes an angularly formed L-shaped region 25 depending from the mounting flange 22 in a complemental configuration for extending through a conventional trunk sealing trough 26 into trunk space 28.

Still referring to FIG. 1, it may be seen that a lower end section of the strut 18 of the bracket 10 includes depending planar region 30 through which said bracket is secured and pivotally orientatable to the trunk lid 12. Interconnecting planar region 30 and the trunk lid 12 is an L-shaped arm 32. The arm 32 is pivotally connected to both the planar region 30 and a mounting plate 34 which is affixed to the trunk lid 12. However, the two pivotal axes are orthogonal to one another because the base planes of each is oriented through arm 32 at a right angle. In this manner the bracket 10 is orthogonally pivotable about the trunk lid 12 facilitating the repositioning of the antenna 16 from a generally vertically upstanding orientation outside the automobile to a generally horizontal position adjacent the underneath side of said trunk lid.

Figure 2:
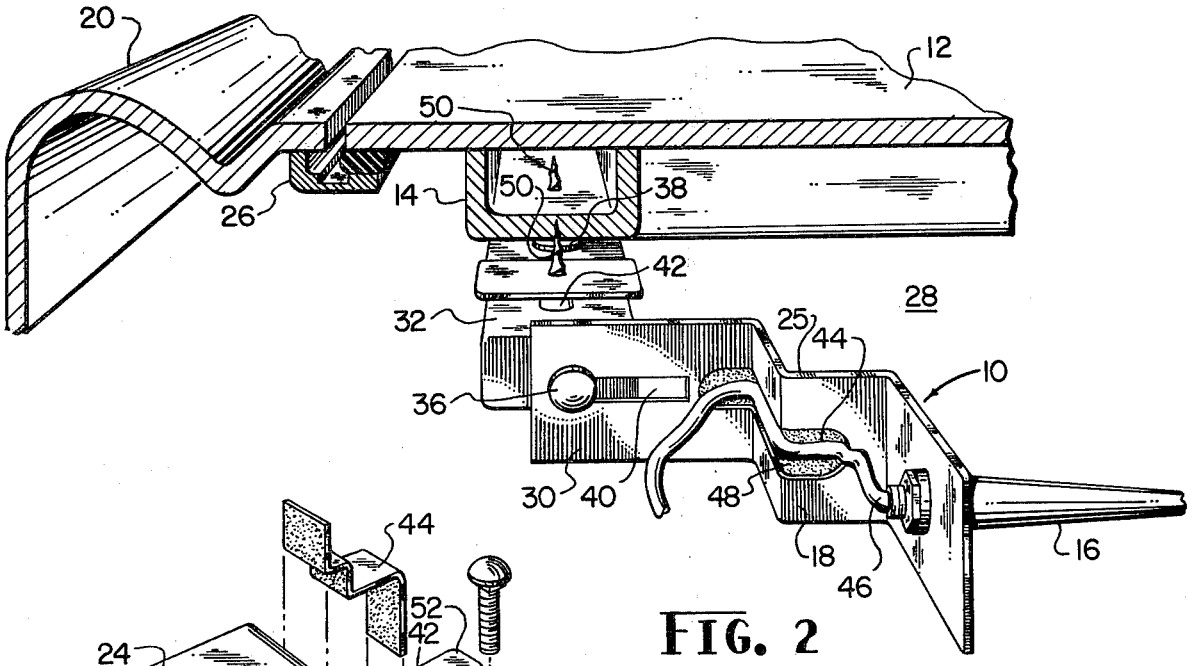
FIG. 2 is a perspective view of the mounting bracket of FIG. 1, shown pivoted to a concealed, storage configuration within the trunk.

Referring now to FIG. 2, the mounting bracket 10 is shown in a collapsed, concealed, stored position within the trunk space 28. In this configuration the antenna 16 may be secured against the inside of the trunk lid 12 so as not to take up valuable trunk space. It may be seen that the horizontal disposition of the bracket 10 is provided through an angular rotation on the order of 90° of the strut 18 around pivotal connecting member 36 extending through planar region 30. The connecting member 36 may be a suitable fastener such as the conventional bolt-wingnut assembly shown in FIG. 1. Similarly, lateral orientation of the bracket 10 is provided through an angular rotation on the order of 90° of the L-shaped arm 32 around pivotal connecting member 38 extending therethrough and through mounting plate 34. The connecting member 38 may also be a suitable fastener such as the bolt-wingnut assembly shown in FIG. 1.

The bolt-wingnut assemblies of connecting members 36 and 38 facilitate the requisite pivotability as well as positionable adjustability. Positional adjustment is provided through the slotted aperture 40 of planar region 30. In this manner the relative positioning of strut 18 with arm 32 may be adjustably controlled to effect the necessary interpositioning of region 25 in trough 26. For certain applications of preselected dimensional configurations, slot 40 could be replaced with one or more apertures. Similarly, a slot 42 may comprise the mounting aperture of arm 32 for coupling to mounting plate 34 to provide the necessary lateral adjustments as required by individual trunk lid configurations.

Figure 3:
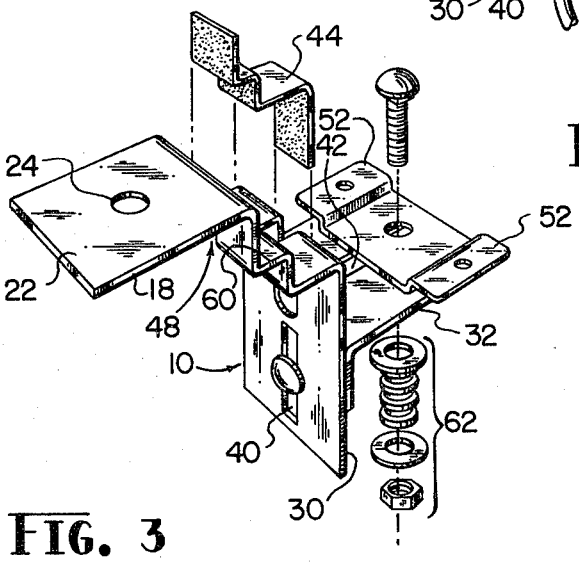
FIG. 3 is a perspective view of an alternative embodiment of an unmounted mounting bracket of the type shown in FIG. 1 without the antenna affixed thereto, and illustrating various alternative constructional configurations and the placement of an adhesive strip thereto for securing the antenna cable thereon.

Referring now to FIG. 3, the mounting bracket 10 is shown prior to assembly of the antenna 16 and trunk lid 12, and a "Z" shaped element 44 is shown in exploded illustration thereabove. Element 44 comprises an antenna cable securing means. As viewed in FIGS. 1 and 2, an antenna cable 46 will depend from the outer mounting flange 22 and is preferably secured to the strut 18 for extension into the trunk space 28 where it can be connected to a radio, or the like (not shown), in the automobile. The cable 46 may be so secured by providing an elongated slot 48 through strut 18 so that the adhesive abuts the cable 46 in the slot 48 and secures same therein.

The bracket 10 is preferably fabricated out of sheet metal such as stainless steel, or the like, and provided with suitable sheet metal screws 50 for securing the mounting plate 34 to the trunk lid 12. Mounting plate 34 is thus preferably formed with outwardly extending apertured flanges 52 for receiving the screws 50. Similarly the central portion 54 of the mounting plate 34 is formed lower than the flanges 52 to provide clearance for the head of the connecting member 38. Preferably said connecting member is a carriage bolt and portion 54 includes a generally rectangularly shaped aperture therethrough for receiving said bolt therein and preventing rotation thereof by mating with the conventionally rectangular neck thereon. In this manner the wingnuts of connecting members 36 and 38 may be manually rotated for adjustment purposes without the threaded member disadvantageously rotating.

Still referring to FIG. 3, there are shown therein alternative constructional configurations of the bracket 10. It may be seen that generally M-shaped region 18 may include an additional L-shaped portion 60 or the like formed in the larger L-shaped region 25 to facilitate attachment to certain automobiles having deeper trunk lid wells. Similarly, the connecting members 36 and 38 may be provided in a spring loaded, hex nut assemblage 62 wherein manual twisting of wingnuts, or the like, is not required for pivotal adjustment of the bracket 10. Assemblage 62 further facilitates orthogonal pivotability functioning when mating faces of the pivoting mounting bracket portions are provided with conventional mating "pimple-dimple" surfaces (not shown) for biasing the relative position therebetween. In this manner the pivoted bracket is, in effect, indexed into position when suitably rotated, which index position is that necessary for correct mounting of the antenna 16.

In the antenna mounting bracket of the present invention, orthogonal pivotability may be seen to be combined with structural rigidity in an economically producible configuration. Moreover, orientation of the antenna 16 from a position of concealment to one of utilization may be seen to be facilitated through the connecting members 36 and 38 and the complemental strut configuration therearound. It is therefore believed that the operation and construction of the above described invention will be apparent from the foregoing description, and while the mounting bracket shown and described has been characterized as being preferred, it will be obvious that various changes and modifications may be made therein without departing from the spirit and scope of the invention as defined in the following claims.

What is claimed is:

1. Apparatus for the generally vertical mounting of an antenna on a trunk lid of an automobile and for the repositioning and securing of the antenna in a generally horizontal, concealed configuration within the trunk storage space therein, said apparatus comprising:

frame means having first and second opposed ends and an intermediate body portion therebetween;

said first frame end including a generally planar flange region having an aperture formed therethrough for receiving the antenna therein and secured mounting thereto in an upstanding relationship therefrom;

said second frame end including mounting means for securing said frame to an underneath portion of the trunk lid and supporting said antenna therefrom;

said body portion comprising an angled strut complementally configured to pass between the trunk lid and the region of the automobile adjacent thereto; and means interposed between said body portion and said second frame end mounting means for providing orthogonal pivotability between said body portion and said mounting means and allowing the antenna to be repositioned from a generally vertically upstanding orientation outside the automobile to a generally horizontal position adjacent the underneath side of the automobile trunk lid, said means including, a right angle bracket having first and second portions formed orthogonal to one another;

said first orthogonal portion including a generally planar region having an aperture formed therethrough and adapted for abutting a generally planar portion of said frame body portion; and said second orthogonal portion including a generally planar region having an aperture formed therethrough and adapted for abutting a generally planar portion of said second frame end mounting means.

2. The apparatus as set forth in claim 1 wherein said planar portion of said frame body adapted for abutting said first orthogonal portion of said right angle bracket includes an apertured region adapted for positioning in registry with said aperture of said right angle bracket and said interposed means include a first fastener member received through said apertures of said abutting apertured regions for adjustably securing one to the other and allowing pivotal movement therebetween.

3. The apparatus as set forth in claim 2 wherein said planar portion of said second frame end mounting means adapted for abutting said second orthogonal portion of said right angle bracket includes an apertured region adapted for positioning in registry with said aperture of said right angle bracket, and said interposed means include a second fastener member received through said apertures of said abutting apertured regions for adjustably securing one to the other and allowing pivotal movement therebetween and orthogonally pivotal movement between said frame body and said second frame end mounting means.

4. The apparatus as set forth in claim 3 wherein said first and second fastener members are each comprised of an elongated member secured in said respective apertures by a spring element bearing thereagainst and producing compression forces between said abutting regions therearound.

* * * * *